US005567079A

United States Patent [19]

Felder

[11] Patent Number: 5,567,079

[45] Date of Patent: Oct. 22, 1996

[54] METHOD FOR THE HYDRAULIC BRANCHING OF AN OPEN STREAM AND HYDRAULICALLY WORKING CHANNEL BRANCH

[76] Inventor: Anton Felder, Schillerstr. 48, D-87435 Kempten, Germany

[21] Appl. No.: 436,197

[22] PCT Filed: Nov. 15, 1993

[86] PCT No.: PCT/EP93/03195

§ 371 Date: May 16, 1995

§ 102(e) Date: May 16, 1995

[87] PCT Pub. No.: WO94/11580

PCT Pub. Date: May 26, 1994

[30] Foreign Application Priority Data

Nov. 17, 1992 [DE] Germany ..... 42 38 830.9

[51] Int. Cl.[6] ..... E02B 3/02

[52] U.S. Cl. ..... 405/80; 405/74; 138/39

[58] Field of Search ..... 405/80, 74, 52, 405/15, 25, 73; 137/803, 804, 825, 561 R, 39; 285/155, 156

[56] References Cited

U.S. PATENT DOCUMENTS

| | | | |
|---|---|---|---|
| 2,813,708 | 11/1957 | Frey | 138/39 X |
| 4,414,757 | 11/1983 | Whipple | 34/155 |
| 4,884,917 | 12/1989 | Christiansen | 405/74 X |

*Primary Examiner*—Stephen J. Novosad
*Attorney, Agent, or Firm*—George W. Dishong

[57] ABSTRACT

The invention relates to a method and an apparatus for the hydraulic branching of an open stream having at least one straight main stream of a specific momentum and having one or more branch streams. Deflection from the main stream is brought about using the Coanda Effect. The hydraulically working channel, i.e., the main stream channel has an upstream corner in common with the branch stream channel which corner is rounded in the form of an arc of a circle between the upstream channel and the branch channel and which converges toward the corner and extends opposite that wall of the upstream channel leading toward the corner and forms with the corner an outflow gap, such that the momentum of the main stream flow which emerges, creates the Coanda Effect, thereby deflecting the controlled flow of water into the branch channel.

21 Claims, 2 Drawing Sheets

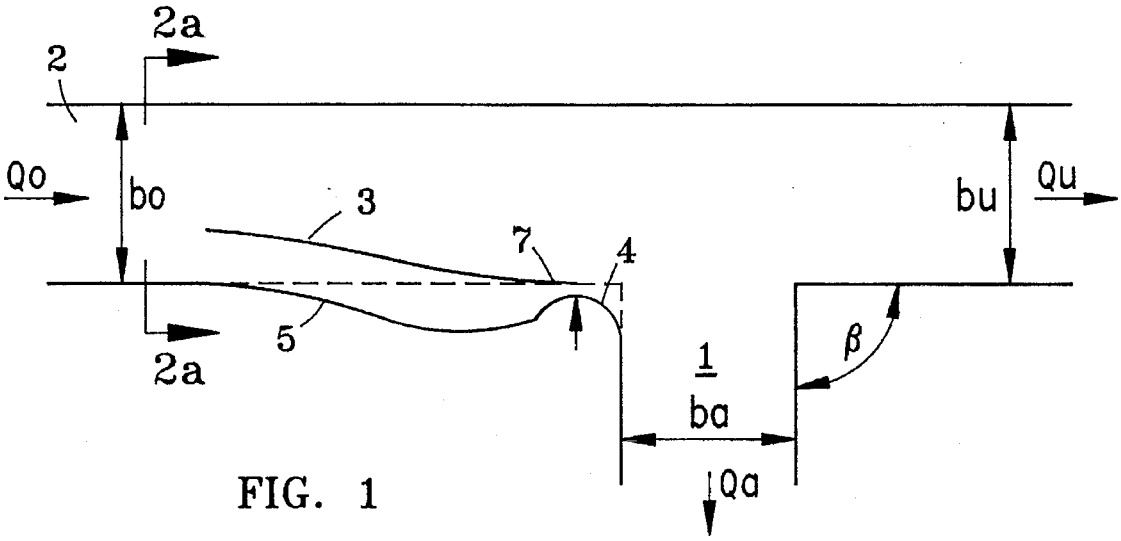
FIG. 1
FIG. 2a
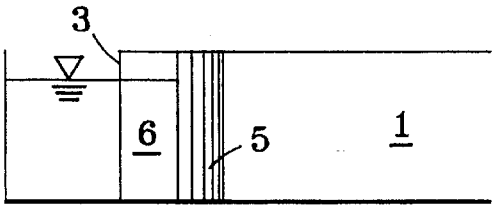
FIG. 2b
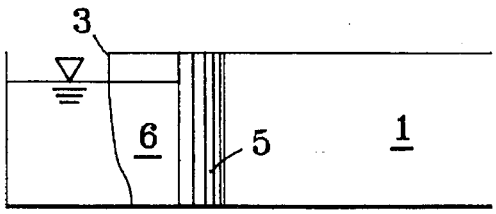
FIG. 2c
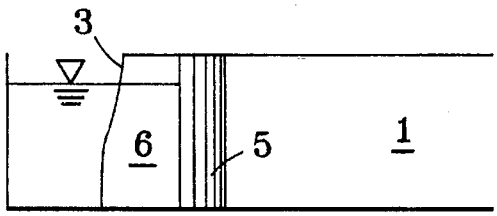

METHOD FOR THE HYDRAULIC BRANCHING OF AN OPEN STREAM AND HYDRAULICALLY WORKING CHANNEL BRANCH

BACKGROUND OF THE INVENTION

1. Field of the Invention

The invention relates to a method for the hydraulic branching of an open stream having at least one straight main stream of a specific momentum and having one or more branch streams.

The subject of the invention is also such a hydraulically working channel branch for the distribution of liquids, particularly water, in open channels.

The subject of the invention is, finally, the use of the method and of the channel branch in hydraulic engineering, residential water supply and irrigation technology.

2. Description of the Prior Art

Channel separations of open channels are encountered in highly specific uses of hydraulics, namely where water has to be distributed. Such problems arise both in hydraulic engineering and in residential water supply and irrigation technology. Whereas, in irrigation systems, the water has to be delivered to fields, in the sewage sector water often has to be dispensed to a basin on the longitudinal side by way of distribution channels. In all uses, the particular feature of a uniform distribution plays the central role. However, the great disadvantage of conventional channel branches is that a uniform or controllable distribution of the water has hitherto been impossible on account of breakaway phenomena and the influences of bends. Moreover, the complex phenomenon has largely eluded elementary analysis.

The branching problem mainly involves the throughflow distribution, that is to say the ratio of the throughflows in the laterally diverging channel branch and the continuous channel branch. The effect of the branch stream is persistently influenced by the width ratio ba/bo (ba width of branch channel, bo width of upstream channel), the branching angle $\beta$ and the through-flow ratio $q = Qa/Qo$ (Qa outflow in branch channel, Qo inflow quantity).

The flow ratios of separating streams have a dead-water zone on the inside of the branch channel and a less pronounced breakaway zone on the outside of the downstream channel. Furthermore, a typical stagnation flow with bottom breakaway is established at the branching edge. The separation streamline on the surface runs approximately axially between the two branches toward the branching edge, whereas the latter extends on the bottom well into the downstream channel. This gives rise to a secondary stream which is in harmony with the breakaway zones and which induces a bottom stream in the direction of the branch channel. Superposed on the primary stream is a spiral secondary stream which, on the surface, flows toward the outside and, on the bottom, therefore flows in the direction of the inside. The water-level drop in the direction of the center of the bend is likewise typical.

The object of the invention is to make such a method for the hydraulic branching of an open stream simple, more effective and better controllable, if possible irrespective of the water level, the inflow quantity, the branching angle and the channel widths.

SUMMARY OF THE INVENTION

The object of the invention is also to make such a hydraulically working channel branch simple in terms of construction for the distribution of water in open channels and, at the same time, guarantee a better controllable distribution irrespective of the water level, the inflow quantity, the branching angle and the channel widths.

In a method of the initially mentioned type for the hydraulic branching of an open stream, this is achieved in that a momentum stream having a momentum of a smaller order of magnitude than that of the main stream is directed toward a common corner between the main stream and the branch stream. The momentum stream is preferably equal to one hundredth of the momentum of the main stream.

It is surprising that, as a result of such a small momentum stream, the branching proceeds in a controllable manner, in that part of the main stream, the branch stream, comes to bear as a whole against the bent wall and transfers the branch stream into the branch channel without the secondary streams and dead-water region which impair the throughput.

According to the invention, the hydraulically working channel branch for the distribution of liquids, particularly water, in open channels comprises a) a common corner, rounded particularly in the form of an arc of a circle, between the upstream channel and the branch channel;

b) a wall which converges toward the corner and extends opposite that wall of the upstream channel leading toward the corner; and c) which forms with the corner an outflow gap, the momentum stream which emerges by the utilization of the Coanda effect coming to bear against the edging of the rounded corner as a wall jet.

In a development of the method, the wall for the main stream merges, upstream of the branching point, rounded and widened in a trough-shaped manner into the branch wall, that is to say the wall for the branch stream.

For deflection, the Coanda effect is expediently brought about by the momentum stream having the higher potential energy.

The jet is induced, without the use of external energy, to build up as far as a gap, to emerge from this gap and to come to bear against the bent wall and consequently uniformly deform the flow field.

In a development of the invention, the small momentum jet can be fed with external water as an external momentum. This can then take place, for example, in such a way that, outside the wall of the main stream and, for example, parallel to the latter, an external momentum stream, for example an external water stream, is guided into the region of the rounded corner and then performs its function of guiding—[sic] the part stream around the corner.

It is particularly useful if the desired division of the wet medium, particularly water, in the channel branch can be controlled in dependence on the magnitude of the outflow momentum.

The channel branch can be designed so that the deflecting angle $\alpha$ at the rounded corner, which corresponds to the branching angle $\beta$, is variable. Different outflow-gap sizes can be formed.

The re-entrant wall in the upstream channel can be straight and continuous over the water depth.

For specific functions involving the aim of guiding a particularly large amount of water along the bottom of the channel, it is possible to deform the re-entrant wall over the water depth according to a functions [sic] predetermined by the desired construction, in such a way that, for example, as seen in an end view, the wall is made cup-shaped, that is to say tapers parabolically from a large gap width at the top toward a small gap width at the bottom.

If the aim is, for example, to have a small amount of water on the bottom of the main stream and a large amount of water on the bottom of the momentum stream for specific reasons, for example in order to influence the momentum in a particular way, for example in order to lower the center of gravity of the momentum, an inverted cup-shaped construction can be provided, the small gap width of the top then widening downward in the form of an inverted parabola.

Depending on the predetermined functions, therefore, the deformation is to be carried out over the water depth according to the desired construction.

It is important, at all events, that the rounded corner form an outflow gap with the opposite inserted wall.

It is undeniable that attempts have already been made, by means of various installations in the region of the channel branch or other constructive measures, such as re-entrant corners and a narrowing of the downstream channel, to achieve a uniform or controllable division of the water in channel branches, but never by means of a hydraulic measure and by utilizing the so-called Coanda effect.

As is known, the working mode of channel branches is persistently influenced by the width ratio Ba/bo, the branching angle β and the throughflow ratio q=Qa/Qo. The result of this is that the distribution of the water in the downstream channel changes constantly and a uniform distribution is therefore never obtained or obtained only in the rarest instances. The measure of the invention signifies here a surprising step forward.

The advantages achieved by means of the invention are, in particular, that the distribution of the water can be controlled by the liquid jet which emerges from the gap and which then comes to bear against the edging of the rounded corner by a utilization of the Coanda effect. The wall jet penetrating into the branch channel in this way ensures that, in contrast to conventional branch channels, consequently no breakaway zone can form on the inside of the branch channel and no dead-water zone can form on the outside of the downstream channel. As seen over the entire channel cross section, the flow pattern is deformed uniformly in relation to the separation streamline. This flow pattern allows both analytic and numerical calculations. It is likewise of enormous importance that, for the division of the water in parts of 50% each into the branch channel and the downstream channel, the momentum, required for this purpose, of the jet emerging from the gap needs to be only 1/100 of the momentum of the main stream.

In general, by Coanda effect is meant the deflection of a jet toward a bent wall. The coming to bear is based on a vacuum effect in the region of the jet edge located on the wall side. By open channels are meant free-level channels.

BRIEF DESCRIPTION OF THE DRAWINGS

Exemplary embodiments of the invention will now be explained in more detail with reference to the accompanying drawings in which FIG. 1 shows a diagrammatic top view of a first embodiment;

FIGS. 2*a*, 2*b* and 2*c* show end views, as seen from the upstream channel of FIG. 1, and FIGS. 3 to 5 show further embodiments varying the design of FIG. 1.

DESCRIPTION OF THE PREFERRED EMBODIMENT

Figure 3:
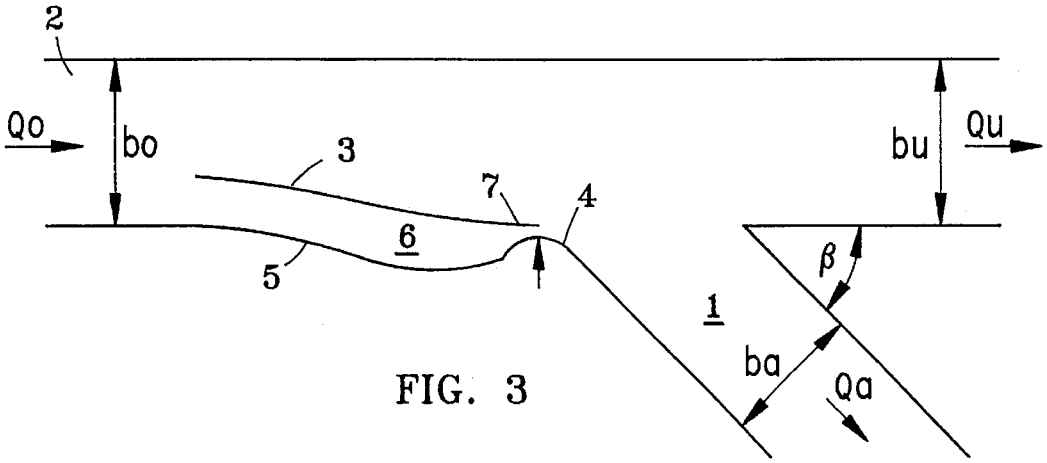
Figure 4:
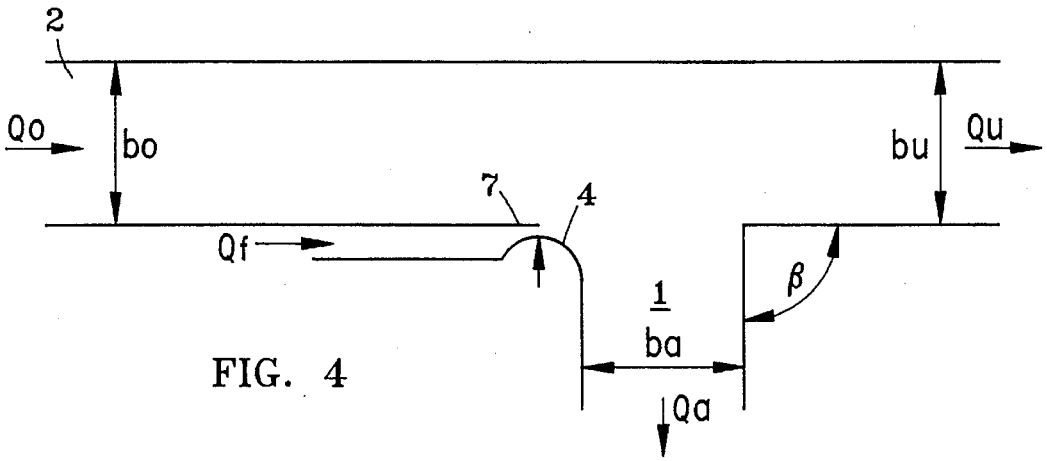

In the embodiment of FIG. 1, a T-branch is shown. A wall 3 re-entrant in the upstream channel 2 is guided in a distortion as far as the rounded corner 4. The re-entrant wall 3 forms, with the side wall 5 of the upstream channel, said side wall 5 leading outward in a distortion, a small side channel 6 which tapers toward the rounded corner, until approximately the original width bo of the upstream channel of the main stream is restored. In relation to the dashed continuous line of the upstream channel, the outward leading side wall 5 of the upstream channel is first bent very slightly out of the straight and then, upstream of the transition to the rounded corner 4, is shaped more sharply in order to form the trough-like design. The wall 5 is therefore widened outward without discontinuities. The water flowing in the small side channel 6 thereby formed is built up appreciably into the region of the gap 7. This takes place through the narrow outflow gap 7 which is formed between the re-entrant wall 3 and the opposite rounded corner 4.

According to the invention, in FIG. 1, the water Qo flows toward the T-branch in the direction of the arrow. The re-entrant wall 3 generates in the upstream channel a particular build up which is maintained in the side channel 6 as far as the outflow gap. However, since approximately the normal water depth is present again in the immediate region of the T-branch, there is a potential difference between the side channel 6 and branch channel 1. The potential difference causes a liquid jet to emerge from the outflow gap 7 and, as a result of the Coanda effect, to flow along the rounded corner 4 into the branch channel 1. The result of this is a uniform deformation of the flow pattern in the T-branch, such that the desired division of the water in dependence on the outflow momentum is achieved.

FIGS. 2*a* to 2*c* show possibilities for varying these conditions, by means of which possibilities the outflow momentum of the jet can be controlled. If, according to FIG. 2*a*, the re-entrant wall 3 is straight over the water depth, according to FIG. 2*b* it is cup-shaped over the water depth, according to FIG. 2*c* is of inverted cup-shaped design, and, depending on the inflow quantity Qo, causes a different build up in the upstream channel 2 and therefore also a jet outflow momentum variable in dependence on this. If the throughflow quantity over the water depth according to FIG. 2*a* is identical from top to bottom in the side channel, as a result of the parabolic design of the wall 3 it decreases according to FIG. 2*b* and increases according to FIG. 2*c* (inverted parabola).

The wall 3 is inserted in such a way that break-aways at the wall do not occur.

In a development according to the invention, the re-entrant wall 3 can consist of a relatively thin metal sheet, in order to separate the stream of the main channel from the side channel. Special steel is possible in the case of sewage channels. This distortion/tapering of the wall 3 should not be more oblique than 8° to the direction of the main stream, so as still to produce the desired effect in general.

FIG. 3 shows an embodiment according to the invention which can be adopted if the branching angle is varied in a range of 10°–160°; the same reference symbols stand for like elements.

Figure 5:
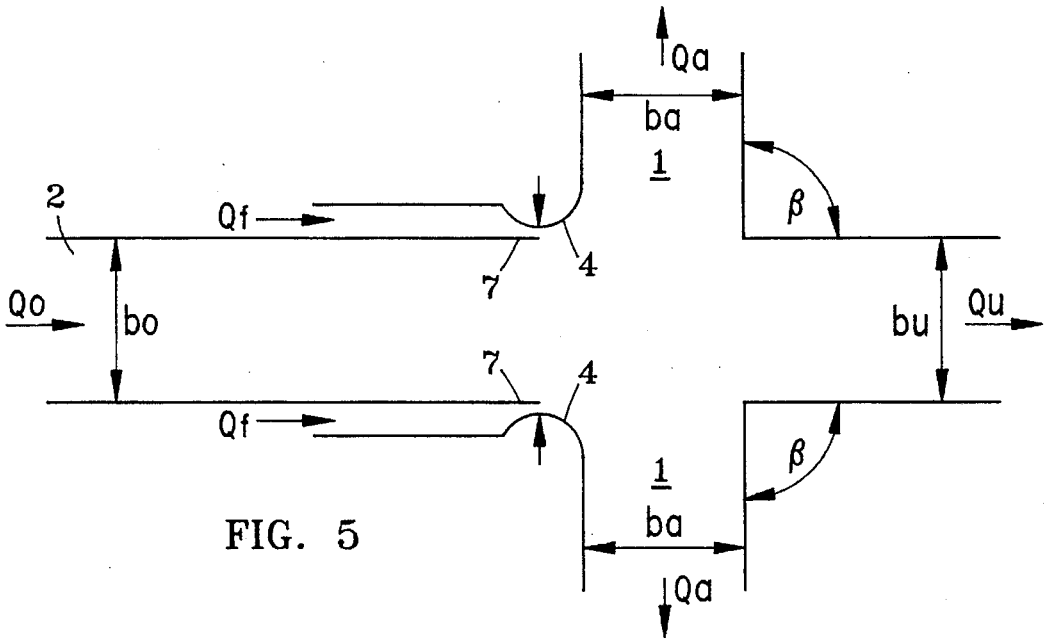

FIG. 5 shows an embodiment with two branch channels, for each of which the width ba and the through-flow Qa are indicated. This is an embodiment with an external energy momentum Qf and the representation is symmetrical in each case. Two outflow gaps 7 are provided opposite one another.

I claim:

1. Method for the hydraulic branching of an open stream having at least one straight main stream of a specific momentum and having one or more branch streams, said method comprising the steps of:

directing a momentum stream having a momentum of a smaller order of magnitude than that of said at least one straight main stream toward a branching point, said branching point having a common rounded corner between said main stream and said branch stream; and causing branching to take place without secondary streams and a dead-water region by creation of conditions to cause deflection of a portion of said main stream into each of said one or more branch streams, said deflection being by a utilization of the Coanda effect.

2. Method according to claim 1, wherein said momentum stream is subtantially equal to about 1/100 of the momentum of said main stream.

3. Method according to claim 1, having a wall for said straight main stream which wall merges, upstream of said branching point rounded and widened in a trough-like manner into a branch wall said branch wall for said branch stream.

4. Method according to claim 3, further comprising inducing a momentum jet of liquid to build up as far as a gap, said momentum jet of liquid to emerge from said gap and come to bear against the bent wall and consequently deform the flow pattern uniformly.

5. Method according to claim 1, further comprising feeding a small momentum jet with external liquid (Qf) as an external momentum.

6. Method according to claim 1, wherein a desired division of fluid of said branch stream is controlled in dependence on the magnitude of outflow momentum.

7. Hydraulically working channel branch for the distribution of liquids, particularly water, in open channels, comprising:

a common corner, rounded particularly in the form of an arc of a circle, between an upstream channel inside wall and a branch channel inside wall;

a re-entrant wall (3) which converges for a predetermined length from upstream toward the common corner (4) and opposite said upstream channel side wall of said upstream channel leading toward the corner (4); and said re-entrant wall and said upstream channel side wall forms a small side channel (6) and with the corner (4), forms an outflow gap (7), and liquid, when flowing through said outflow gap, creating thereby a momentum stream which emerges from said outflow gap and by a utilization of the Coanda effect coming to bear against the edging of the rounded corner (4) as a wall jet.

8. Channel branch according to claim 7, further comprising a deflecting angle at said rounded corner (4), which deflecting angle corresponds to a branching angle (β), said deflection angle and said branching angle being between about 10 and 90 degrees.

9. Channel branch according to claim 7, wherein said outflow gap is may be formed of different sizes.

10. Channel branch according to claim 7, wherein said re-entrant wall (3) in the upstream channel (2) is deformed over the water depth according to a function predetermined by the desired build-up.

11. Channel branch according to claim 10, wherein the shape of said re-entrant wall (3) is cup-shaped.

12. Channel branch according to claim 10, wherein the shape of said re-entrant wall (3) is inversely cup-shaped.

13. Channel branch according to claim 7, further comprising an external water feed (Qf) as an external momentum for generating an outflow jet from the gap (7).

14. Channel branch according to claim 7, wherein said upstream channel side wall (5) of the upstream channel of the main stream leading toward the rounded corner is designed as set back in a trough-like manner (5).

15. Channel branch according to claim 14, further comprising a transition section out of a straight section of said small side channel (6) which transition section, from upstream toward said rounded corner (4), is first bent very slightly and then is shaped more sharply approaching said rounded corner (4) in order to form a trough-like design.

16. Method for controllable distribution of liquid from an open stream volume of liquid into at least one branch stream, each said at least one branch stream having a specific branch stream volume as a fraction of said open stream volume, said method comprising the steps of:

forming at least one straight main stream from said open stream;

branching hydraulically said at least one straight main stream into said at least one branch stream of specific branch stream volume, said branching hydraulically accomplished by the steps of;

developing, in each said at least one straight main stream of fluid, a momentum stream having a momentum stream momentum of a smaller order of magnitude than a main stream momentum of each said at least one straight main stream; and directing each said momentum stream toward a common rounded corner between one of said main streams and one of said branch streams said branching hydraulically to take place substantially without secondary streams and substantially without a dead-water region by creation of conditions to cause deflection of a portion of said main stream into each of said one or more branch streams, said deflection being by a utilization of the Coanda effect.

17. Method according to claim 16, wherein said momentum stream momentum is subtantially equal to about 1/100 of said main stream momentum.

18. Method according to claim 16, wherein a wall of a main stream channel for said straight main stream merges, upstream of said branching point, said branching point being a common rounded corner and widened in a trough-like manner into a branch wall of a branch channel for said branch stream.

19. Method according to claim 18, further comprising the step of inducing a jet to build up as far as a gap, said jet to emerge from this gap and to come to bear against the bent wall and consequently deform the flow pattern uniformly.

20. Method according to claim 16, further comprising feeding a small momentum jet with external fluid (Qf) as an external momentum.

21. Method according to claim 16, wherein a desired division of fluid of said branch stream is controlled in dependence on the magnitude of outflow momentum.

* * * * *